US005711449A

United States Patent [19]

Arn

[11] Patent Number: 5,711,449

[45] Date of Patent: Jan. 27, 1998

[54] ENTRY ASSEMBLY

[75] Inventor: Robert W. Arn, Jacksonville, Fla.

[73] Assignee: Petroleum Containment, Inc., Jacksonville, Fla.

[21] Appl. No.: 570,494

[22] Filed: Dec. 11, 1995

[51] Int. Cl.[6] ..... B65D 4/06; B65D 90/10

[52] U.S. Cl. ..... 220/293; 220/4.12; 220/304; 220/484; 220/377; 220/378

[58] Field of Search ..... 220/377, 601, 220/602, 484, 293, 288, 296, 298, 301, 4.03, 4.04, 4.12, 4.13, 565, 465, 304, 295, 319, 378; 292/256.5; 404/25, 26; 277/169

[56] References Cited

U.S. PATENT DOCUMENTS

| | | | |
|---|---|---|---|
| 1,923,481 | 8/1933 | Ford | 220/484 |
| 2,056,947 | 10/1936 | Baechle | 220/296 X |
| 2,661,862 | 12/1953 | Howe | 220/296 |
| 2,867,350 | 1/1959 | Fleckenstein | 220/304 X |
| 3,322,432 | 5/1967 | Soguel | 277/169 |
| 4,667,449 | 5/1987 | Keating et al. | 220/293 X |
| 4,936,705 | 6/1990 | Schneider | 220/426 X |
| 5,017,044 | 5/1991 | Sharp | 220/4.13 X |
| 5,246,133 | 9/1993 | James | 220/602 X |

FOREIGN PATENT DOCUMENTS

| | | | |
|---|---|---|---|
| 28845 | 4/1925 | France | 330/293 |
| 338024 | 3/1920 | Germany | 220/293 |
| 1264666 | 2/1972 | United Kingdom | 220/293 |

*Primary Examiner*—Allan N. Shoap
*Assistant Examiner*—Nathan Newhouse
*Attorney, Agent, or Firm*—Arthur G. Yeager

[57] ABSTRACT

A closure assembly for attachment to a vessel having an opening ring of a vessel and a closing cover cooperating with the ring and including a large diameter base end attached to the vessel and a small diameter ring end to receive a removable cover thereover. The cover end includes a plurality of spaced inwardly protruding locking lugs having a lower surface slightly inclined and the cover includes a perimeter ring flange, having a first downwardly depending skirt spaced closely adjacent and inwardly from the ring locking lugs and a second downwardly depending skirt spaced outwardly therefrom. The first skirt has outwardly protruding locking lugs spaced downwardly from the ring flange and having a slightly inclined upper surface to wedgingly mate with respective lower surfaces of the ring locking lugs. The cover has an interior surface between the first and second skirts and a D-ring seal located between the flanges on the interior surface for contacting and being compressed by the small diameter ring end.

18 Claims, 3 Drawing Sheets

ENTRY ASSEMBLY

TECHNICAL FIELD

This invention relates to providing a closable entry into a containment vessel, and more particularly to provide a leakproof cover for an entryway into an underground containment vessel.

BACKGROUND OF THE INVENTION

Entry covers for underground vessels, sewers, etc., have in the past generally been accomplished by welding, bolting or brazing a neck opening to the vessel or sewer and a heavy (cast iron) manhole cover is applied thereto. Such covers rust and leak, and become hazardous to the equipment in the vessel. When such entryways are below ground level, there is a very good possibility that ground water may leak past the cover and get inside the vessel and destroy whatever equipment is enclosed in the vessel. Improved, lightweight, leakproof entryways have been needed for some time, but none were available.

It is an object of this invention to provide an improved covered entryway for underground containment vessels.

It is another object of this invention to provide a lightweight entryway with a locking cover that is leakproof, Still other objects will become apparent from the more detailed description which follows.

BRIEF SUMMARY OF TEE INVENTION

This invention relates to a closure for attachment to a vessel which comprises an opening ring for attachment to a vessel and a closing cover adapted to cooperate with said ring; said ring comprising a tapered cylindrical ring having a large diameter planar base end adapted to be attached to said vessel and a small diameter planar cover end adapted to receive a cover, said cover end including a plurality of inwardly protruding locking lugs having an upper surface included in said small diameter planar cover end and a lower surface inclined at a small angle to such upper surface; said cover comprising a perimeter ring flange, a central window, and a domed structure joining said perimeter ring flange to said window, said perimeter ring flange having a first downwardly depending skirt from said perimeter ring flange spaced closely adjacent inwardly from said locking lugs of said opening ring, and a second downwardly depending skirt spaced outwardly from said first skirt, said first skirt including outwardly protruding locking lugs spaced downwardly from said ring flange and having an inclined upper surface to mate with said lower inclined surface of said locking lugs on said opening ring, said cover having an interior surface between said first and second skirts to which is affixed an elastic D-ring seal adapted to be contacted and compressed by said small diameter planar cover end of said opening ring.

In specific and preferred embodiments of this invention, there are four circumferentially spaced locking lugs on each of the cover and the opening ring that lock together as screw threads when the cover is turned about the axis and the opening ring remains immobile. In another specific and preferred embodiment the closure assembly is made of fiber-reinforced plastic sheet material molded into the desired shapes. In still another specific and preferred embodiment there is an outer skirt on the cover to protect the contiguous surfaces of the locking lugs from contact with the surrounding soil.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood with the accompanying drawings in which:

DETAILED DESCRIPTION OF THE INVENTION

The features of this invention are best understood by reference to the attached drawings wherein the component parts are numbered.

Figure 2:
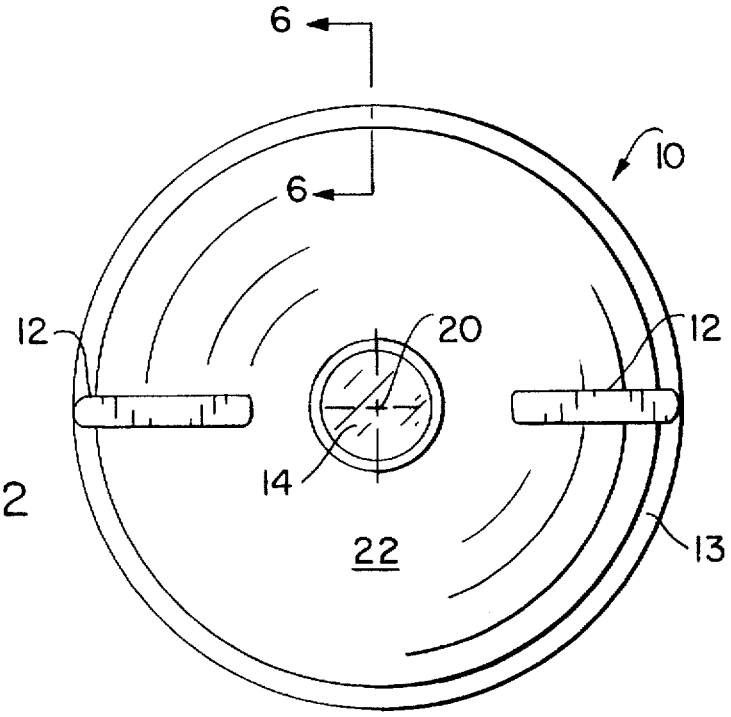
FIG. 2 is a top plan view of the cover of the closure assembly of this invention.
Figure 1:
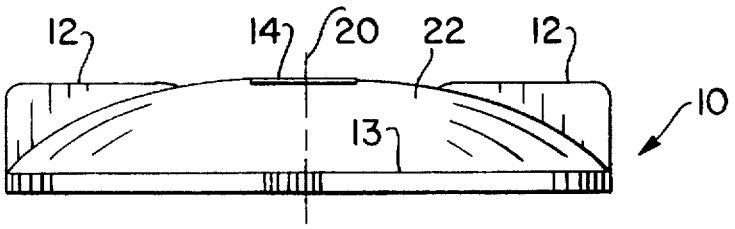
FIG. 1 is a front elevational view of the cover of the closure assembly of this invention.
Figure 3:
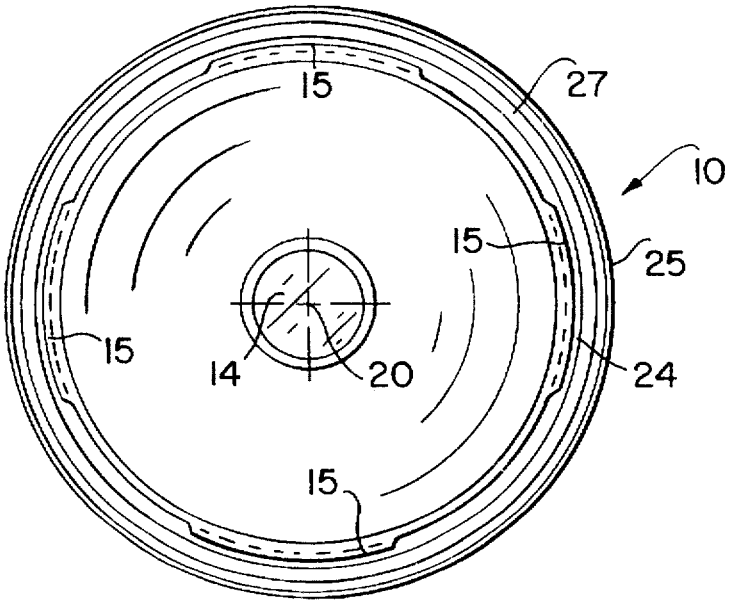
FIG. 3 is a bottom plan view of the cover of the closure assembly of this invention.
Figure 4:
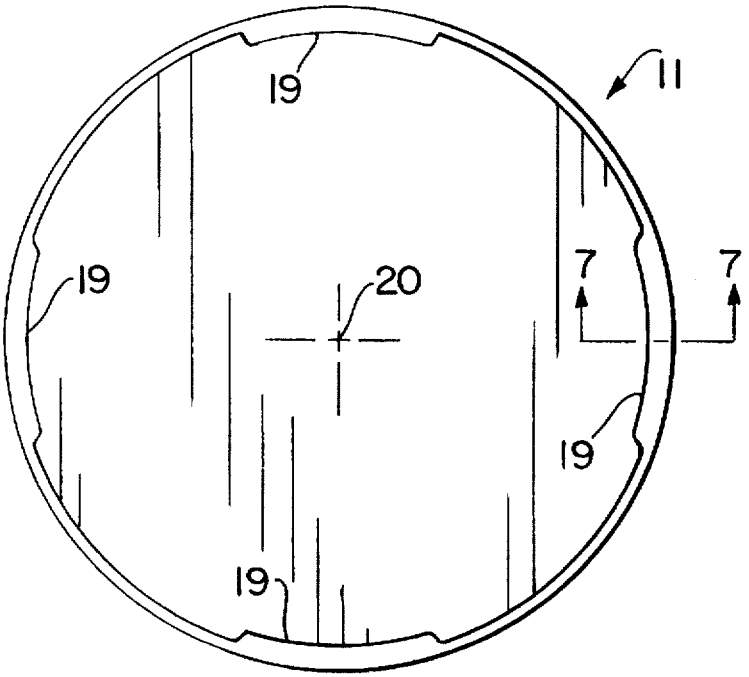
FIG. 4 is a top plan view of the closure ring of the closure assembly of this invention.
Figure 5:
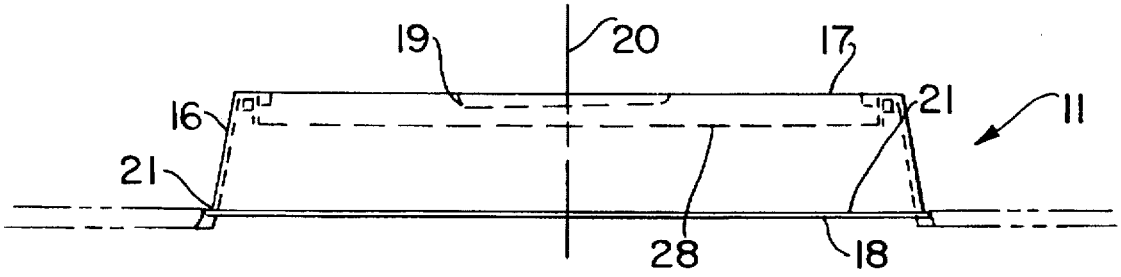
FIG. 5 is a front elevational view of the closure ring of the closure assembly of this invention.

The closure assembly of this invention includes a cover 10 shown in FIGS. 1–3 and an opening ring 11 shown in FIGS. 4–5, the opening ring 11 being attached to a vessel into which a person must have access for the purpose of maintenance of equipment or other reason. The opening may be large enough to allow a human body to pass through, as in a manhole assembly, or it may be small enough to allow hands to reach into the vessel. The vessel usually is underground and houses a pump or other equipment through which a liquid must flow, e.g., petroleum, gasoline, water, chemical solution, etc. In each instance the present invention is designed to be leakproof, lightweight, corrosion proof and easy to operate.

Cover 10 has a central window 14 for visual inspection of the interior of the vessel, and two handles 12 positioned along a diameter of cover 10 with an outer end at the perimeter of cover 10 in an inner end adjacent window 14. Cover 10 must be turned about central longitudinal axis 20 when being opened or closed with respect to opening ring 11, and therefore, handles 12 are pushed or pulled to accomplish that turning.

The bottom plan view of cover 10 as seen in FIG. 3 shows four circumferentially spaced locking lugs 15 which extend outwardly from first skirt 24 which is a cylindrical wall hanging downwardly from the top of cover 10. Cover 10 has a domed section which extends outwardly from window 14 to a perimeter flange portion 13. Depending downwardly from flange 13 is a first or inner skirt 24 and a second or outer skirt 25. The positions of these skirts may be seen in the cross-sectional drawings of FIGS. 6 and 7 which will be described below. Extending outwardly from first skirt 24 are a plurality of locking lugs 15 which cooperate with similar locking lugs on opening ring 11 to lock cover 10 to ring 11. Between first skirt 24 and second skirt 25 is a circular gasket or ring seal 27, having a cross-sectioned shape of a D, which provides the leak-proof contact between cover 10 and opening ring 11.

FIGS. 4 and 5 show two views of the opening ring 11, which forms the connection tunnel between the containment vessel enclosing equipment that must be accessible and the cover which closes the opening.

Opening ring 11 has a lower, larger base end 18 and an upper, smaller cover end 17, both preferably planar, although lower base end 18 may be made to be curved or skewed or otherwise nonplanar so as to fit the containment vessel into which access is desired. A flange 21 extends outwardly around the perimeter of lower base end 18 to receive holes for bolts to attach opening ring 11 to the containment vessel. Upper cover end 17 is smaller in diameter than lower base end 18 and the two ends 17, 18 are joined by a tapered cylindrical wall or body 16. It is not critical that body 16 be tapered or that cover end 17 be smaller than base end 18, since these components are made to fit the containment vessel as it is found. Cover end 17 is planar so as to fit the planar portions of cover 10. A plurality (four shown in FIG. 4) of locking lugs 19 extend inwardly from a single downwardly depending skirt 28. Lugs 19 are positioned so as to mate with lugs 15 on cover 10 after the fashion of screw threads. This feature will be more readily understood with respect to FIGS. 6–7 described below.

Figure 6:
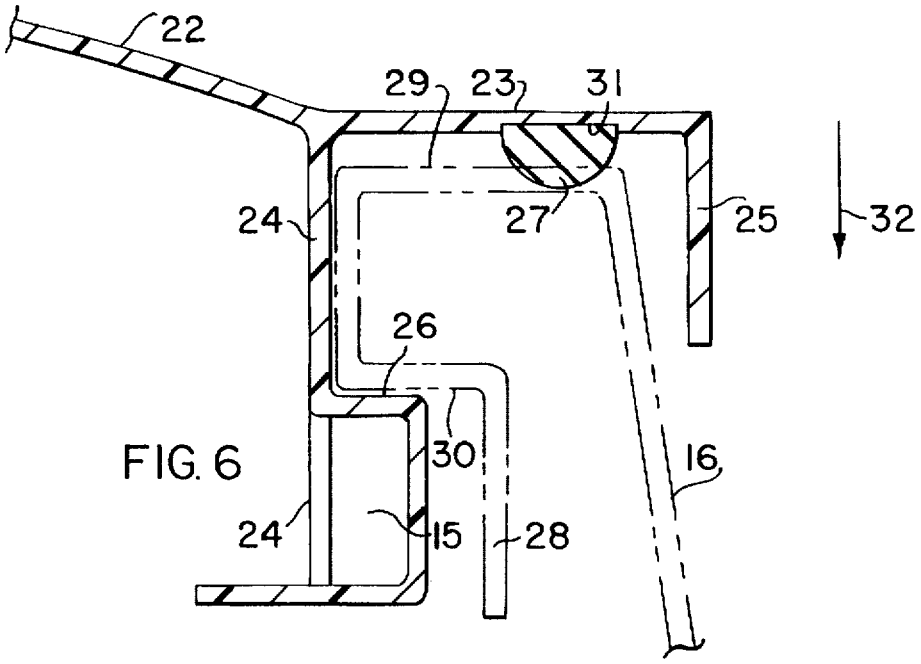
FIG. 6 is a cross-sectional view taken at 6—6 of FIG. 2.
Figure 7:
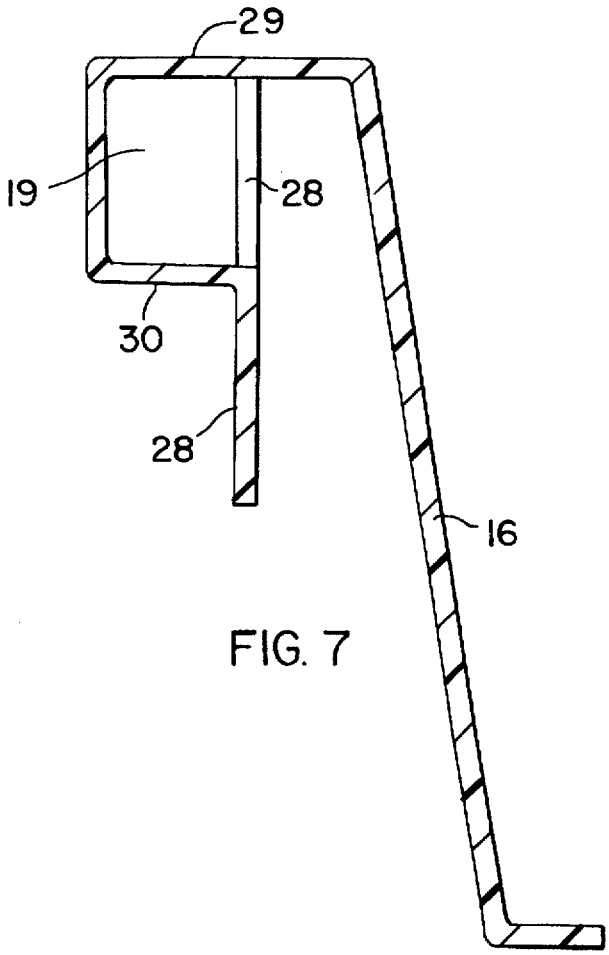
FIG. 7 is a cross-sectional view taken at 7—7 of FIG. 4.

In FIGS. 6 and 7 there are shown cross-sections of the two components, cover 10 and ring 11 as they fit together when the opening is closed. The locking lugs, 15 on cover 10 and 19 on ring 11, contact each other along inclined surfaces. The lower surface 30 of lugs 19 and the upper surface 26 of lugs 15 are each inclined at the same angle from a plane perpendicular to axis 20 so that when cover 10 is turned with respect to ring 11, cover 10 will tighten onto ring 11; locking lugs 15 and 19 functioning as portions of-screw threads to produce the clamping action. It must be noted that lugs 15 and 19 are located vertically so as to contact each other. Lugs 15 of cover 10 are shown to be spaced downwardly on first skirt 24 from flange 23. Lugs 19 are positioned along top planar cover end 17 of ring 11, thus permitting lugs 15 and 19 to mesh with each other. Still another feature is that an elastic O-ring, having a D-shaped cross-section, commonly referred to as a D-ring or D-ring seal 27 is affixed to the surface of cover 10 between first inner skirt 24 and second outer skirt 25, preferably seated in a circumferential undercut 31, and when cover 10 is applied to ring 11 and turned to clamp it to ring 11, cover 10 moves downwardly in the direction of arrow 32 to clamp D-ring 27 against the top cover surface 17, distorting D-ring 27 to form a leakproof seal.

The component parts of the closure assembly of this invention are preferably made of fiber-reinforced plastic, i.e., glass fiber, carbon fiber, or the like reinforcing a thermosetting polyester resin. This produces a smooth corrosion-proof surface on a stiff member 0.0625–0.25 inch thick. Preferably the member is 0.125 inch thick.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A leakproof closure assembly for attachment to an underground vessel which comprises an enlarged opening ring for attachment to a vessel and an enlarged closing cover for sealing against said ring and preventing water egress into said vessel; said ring comprising a tapered cylindrical ring having a large diameter planar base end adapted to be attached to said vessel and a smaller diameter planar cover end adapted to receive a cover, said cover end of said base including at least three equally spaced and inwardly protruding locking lugs having an upper surface formed substantially co-planar with said small diameter planar cover end and a lower surface spaced therefrom and inclined at a small angle to said upper surface; said cover including a perimeter ring flange, a central window, and a domed structure joining said perimeter ring flange to said window, said perimeter ring flange having a first downwardly depending skirt from said perimeter ring flange spaced closely adjacent inwardly from said locking lugs of said opening ring, and a second downwardly depending skirt, spaced outwardly from said first skirt, said first skirt including at least three equally spaced and outwardly protruding locking lugs spaced downwardly from said ring flange and having an inclined upper surface to wedgingly mate with respective said lower inclined surfaces of said locking lugs on said opening ring, said locking lugs of said cover having lower surfaces substantially parallel to said upper surface of said cover end, said cover having an interior surface between said first and second skirts substantially parallel to said upper surface of said cover end, an elastic O-ring having a D-shaped cross-section affixed on its flat to said interior surface and being contacted and compressed by said smaller diameter planar cover end of said opening ring upon substantial wedging of all said locking lugs by rotation of said cover.

2. The closure assembly of claim 1 wherein said opening ring and said cover are made of fiber-reinforced plastic sheet material 0.0625–0.25 inch thick.

3. The closure assembly of claim 1 wherein the downwardly depending length of said second skirt is about one-half the downwardly depending length of said first skirt.

4. The closure assembly of claim 1 wherein said base end of said opening ring has an outwardly extending flange around the perimeter of said base end.

5. The closure assembly of claim 1 wherein said small diameter planar cover end includes a downwardly depending skirt positioned spacedly outwardly of outer extremities of said locking lugs of said cover and having a downwardly depending length sufficient to reach the lower extremities of said locking lugs of said cover; said locking lugs of said opening ring extending inwardly from said skirt of said opening ring.

6. The closure assembly of claim 1 wherein said domed surface of said cover includes a pair of spaced upwardly protruding handle tabs at opposite ends of a diameter of said cover for use in turning said cover.

7. A corrosion-proof, leak-proof openable closure assembly for an underground containment vessel comprising an opening ring and an opening cover; said opening ring having a tapered cylindrical body with a longitudinal axis and a central axial hollow, a planar base end and a planar cover end, said base end including a flange adapted to be joined to said containment vessel, and said cover end having a planar surface and a skirt depending therefrom to form a right cylindrical surface around said longitudinal axis and at least three equally spaced locking lugs protruding inwardly from said skirt adjacent said planar surface, each said lug having an upper planar surface lying in said cover end and a lower surface spaced downwardly from said upper surface and being inclined at a small angle from said upper surface; said cover including a domed central portion surrounded by a planar circular perimeter flange, and a circular planar window substantially centrally of said domed portion; said flange including an inner skirt and an outer skirt both depending downwardly from said flange and spaced apart radially from said axis, said inner flange having at least three equally spaced locking lugs protruding outwardly from said inner skirt adjacent its bottom and spaced downwardly from said flange, each said lug having an upper surface inclined at the same angle from said flange as the lower surface of said lugs on said opening ring, said outer skirt extending downwardly about one-half of the downward length of said inner skirt.

8. The closure assembly of claim 7 wherein said opening ring and said cover are made of fiber-reinforced plastic sheet material about 0.125 inch thick.

9. The closure assembly of claim 7 wherein said locking lugs of said opening ring and said locking lugs of said cover mate with each other along their respective inclined surfaces as portions of screw threads when said cover is turned about said longitudinal axis while said opening ring is immobile.

10. The closure assembly of claim 7 wherein said cover includes two upwardly protruding lugs positioned respectively at opposite ends of a diameter and extending from said flange to adjacent said window and extending upwardly sufficient to provide a handhold when turning said cover to open or close said cover on said opening ring.

11. A closure assembly for attachment to a vessel which comprises an opening ring for attachment to a vessel and a closing cover adapted to cooperate with said ring; said ring including a tapered cylindrical ring having a large diameter planar base end adapted to be attached to said vessel and a small diameter planar cover end adapted to receive a cover, said cover end including at least three equally spaced inwardly protruding locking lugs adjacent its top, each said lug having an upper surface and a lower surface inclined at a small angle to respective said upper surfaces; said cover including a perimeter ring flange, said perimeter ring flange having a first downwardly depending skirt spaced closely adjacent and inwardly from said locking lugs of said opening ring, and a second downwardly depending skirt spaced outwardly therefrom, said first skirt including at least three equally spaced outwardly protruding locking lugs spaced downwardly from said ring flange and being adjacent its bottom, each said lug having an inclined upper surface to wedgingly mate with respective said lower inclined surfaces of said locking lugs on said opening ring, said cover having an interior surface between said first and second skirts, and sealing means located between said skirts on said interior surface for contacting said opening ring when said cover is engaged therewith, said sealing means being compressed by wedging forces of all said lugs to seal said opening ring and vessel against water intrusion.

12. The closure assembly of claim 11 wherein said cover includes a generally central window for providing visual inspection into said vessel without removal of said cover from said vessel.

13. The closure assembly of claim 11 wherein said first skirt extends downwardly generally twice as far as said second skirt.

14. The closure assembly of claim 11 wherein said base end of said opening ring includes an outwardly extending portion, and wherein said sealing means includes an elastic D-ring seal engaged with said outwardly extending portion of said opening ring and sealed thereagainst.

15. The closure of claim 11 further including two upwardly protruding handles integral with said cover for use in releasably securing said cover to said vessel.

16. The closure assembly of claim 11 wherein said locking lugs of said opening ring and said locking lugs of said cover mate with each other along their respective inclined surfaces as portions of screw threads when said cover is turned about a longitudinal axis while said opening ring of said vessel is immobile.

17. The closure assembly of claim 16 wherein said first skirt extends downwardly generally twice as far as said second skirt and said cover includes a central inspection window.

18. The closure assembly of claim 17 further including two upwardly protruding handles integral with said cover for use in releasably securing said cover to said vessel.

* * * * *

US005711449C1

(12) EX PARTE REEXAMINATION CERTIFICATE (8026th)

United States Patent
Arn

(10) Number: US 5,711,449 C1
(45) Certificate Issued: Feb. 15, 2011

(54) ENTRY ASSEMBLY

(75) Inventor: Robert W. Arn, Jacksonville, FL (US)

(73) Assignee: Petroleum Containment, Inc., Jacksonville, FL (US)

Reexamination Request:
No. 90/009,667, Mar. 8, 2010

Reexamination Certificate for:

| | |
|---|---|
| Patent No.: | **5,711,449** |
| Issued: | **Jan. 27, 1998** |
| Appl. No.: | **08/570,494** |
| Filed: | **Dec. 11, 1995** |

(51) Int. Cl.
*B65D 41/06* (2006.01)
*B65D 90/10* (2006.01)

(52) U.S. Cl. ..... 220/293; 220/304; 220/377; 220/378; 220/4.12; 220/484

(58) Field of Classification Search ..... None
See application file for complete search history.

(56) References Cited

U.S. PATENT DOCUMENTS

| | | | | | |
|---|---|---|---|---|---|
| 1,833,928 | A | * | 12/1931 | Bell | 220/302 |
| 1,995,939 | A | * | 3/1935 | Osten | 114/178 |
| 2,388,561 | A | * | 11/1945 | Morris et al. | 292/6 |
| 2,609,117 | A | * | 9/1952 | Miller | 220/302 |
| 3,436,085 | A | * | 4/1969 | Polk | 277/596 |
| 3,942,677 | A | * | 3/1976 | Hagen et al. | 220/304 |
| 4,081,102 | A | * | 3/1978 | Sakai | 220/203.24 |
| 4,828,274 | A | * | 5/1989 | Stannard | 277/641 |
| 5,378,078 | A | * | 1/1995 | Lewis et al. | 404/25 |
| 5,496,128 | A | * | 3/1996 | Odill | 404/25 |

* cited by examiner

*Primary Examiner*—William C Doerrler

(57) ABSTRACT

A closure assembly for attachment to a vessel having an opening ring of a vessel and a closing cover cooperating with the ring and including a large diameter base end attached to the vessel and a small diameter ring end to receive a removable cover thereover. The cover end includes a plurality of spaced inwardly protruding locking lugs having a lower surface slightly inclined and the cover includes a perimeter ring flange, having a first downwardly depending skirt spaced closely adjacent and inwardly from the ring locking lugs and a second downwardly depending skirt spaced outwardly therefrom. The first skirt has outwardly protruding locking lugs spaced downwardly from the ring flange and having a slightly inclined upper surface to wedgingly mate with respective lower surfaces of the ring locking lugs. The cover has an interior surface between the first and second skirts and a D-ring seal located between the flanges on the interior surface for contacting and being compressed by the small diameter ring end.

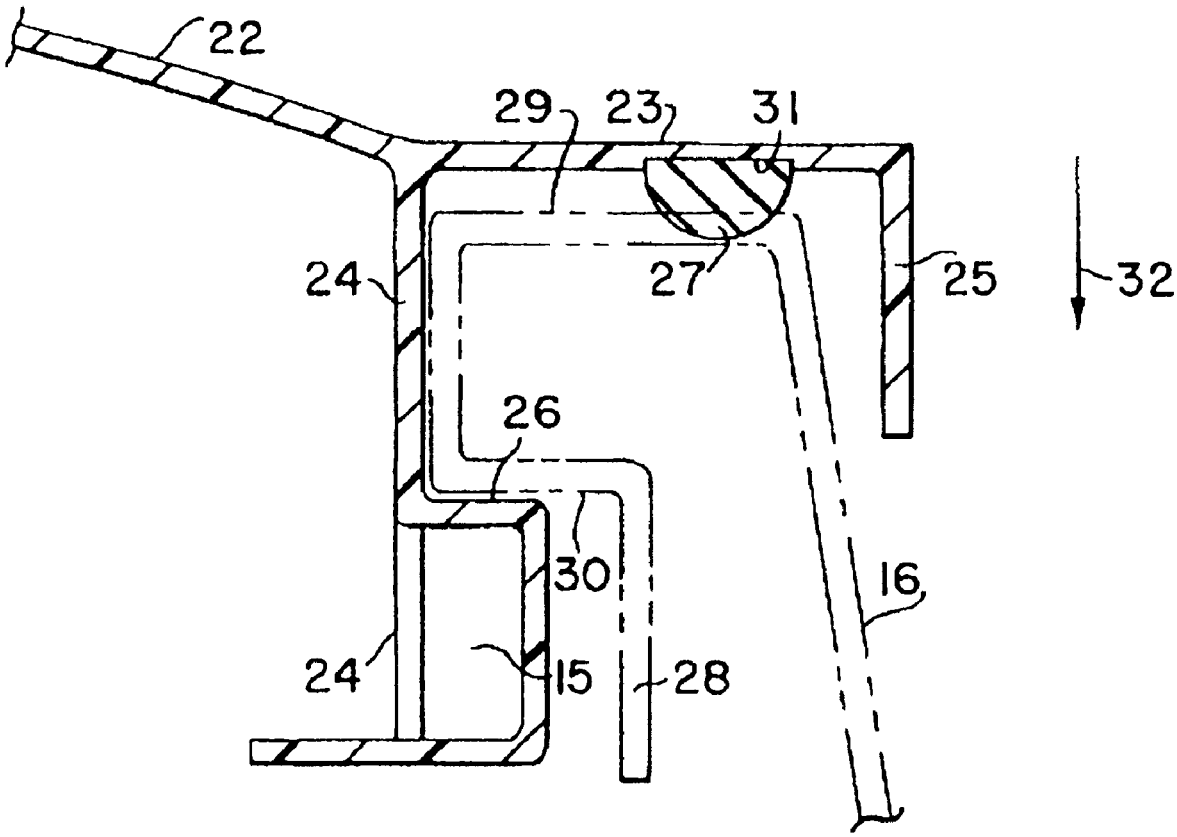

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-10 is confirmed.

Claims 12, 17 and 18 are cancelled.

Claim 11 is determined to be patentable as amended.

Claims 13-16, dependent on an amended claim, are determined to be patentable.

New claims 19 and 20 are added and determined to be patentable.

11. A closure assembly for attachment to a vessel which comprises an opening ring for attachment to a vessel and a closing cover adapted to cooperate with said ring; said ring including a tapered cylindrical ring having a large diameter planar base end adapted to be attached to said vessel and a small diameter planar cover end adapted to receive a cover; *wherein said cover includes a generally central window for providing visual inspection into said vessel without removal of said cover from said vessel,* said cover end including at least three equally spaced inwardly protruding locking lugs adjacent its top, each said lug having an upper surface and a lower surface inclined at a small angle to respective said upper surfaces; said cover including a perimeter ring flange, said perimeter ring flange having a first downwardly depending skirt spaced closely adjacent and inwardly from said locking lugs of said opening ring, and a second downwardly depending skirt spaced outwardly therefrom, said first skirt including at least three equally spaced outwardly protruding locking lugs spaced downwardly from said ring flange and being adjacent its bottom, each said lug having an inclined upper surface to wedgingly mate with respective said lower inclined surfaces of said locking lugs on said opening ring, said cover having an interior surface between said first and second skirts, and sealing means located between said skirts on said interior surface for contacting said opening ring when said cover is engaged therewith, said sealing means being compressed by wedging forces of all said lugs to seal said opening ring and vessel against water intrustion.

*19. A closure assembly for attachment to a vessel which comprises an opening ring for attachment to a vessel and a closing cover adapted to cooperate with said ring; said ring including a tapered cylindrical ring having a large diameter planar base end adapted to be attached to said vessel and a small diameter planar cover end adapted to receive a cover, said cover end including at least three equally spaced inwardly protruding locking lugs adjacent its top, each said lug having an upper surface and a planar lower surface inclined at a small angle to respective said upper surfaces; said cover including a perimeter ring flange, said perimeter ring flange having a first downwardly depending skirt spaced closely adjacent and inwardly from said locking lugs of said opening ring, and a second downwardly depending skirt spaced outwardly therefrom, said first skirt including at least three equally spaced outwardly protruding locking lugs spaced downwardly from said ring flange and being adjacent its bottom, each said lug having an inclined planar upper surface to wedgingly mate with respective said planar lower inclined surfaces of said locking lugs on said opening ring, said cover having an interior surface between said first and second skirts, and sealing means located between said skirts on said interior surface for contacting said opening ring when said cover is engaged therewith, said sealing means being compressed by wedging forces of all said lugs to seal said opening ring and vessel against water intrusion.*

*20. The closure assembly of claim 19 wherein said locking lugs of said opening ring and said locking lugs of said cover mate with each other along their respective planar inclined surfaces in the manner of screw threads when said cover is turned about a longitudinal axis while said opening ring of said vessel is immobile.*

* * * * *